United States Patent [19]

Martin

[11] Patent Number: 4,852,287

[45] Date of Patent: Aug. 1, 1989

[54] SHOOTERS HEAD IMMOBILIZING APPARATUS

[76] Inventor: Maurice Martin, 13 Ashbrook Rd., Exeter, N.H. 03833

[21] Appl. No.: 250,665

[22] Filed: Sep. 29, 1988

[51] Int. Cl.[4] ..... F41C 27/00

[52] U.S. Cl. ..... 42/90; 42/72

[58] Field of Search ..... 42/90, 71.01, 72

[56] References Cited

U.S. PATENT DOCUMENTS 455,827 7/1891 Duncan ..... 42/71.01

803,791 11/1905 Shattuck ..... 42/72

*Primary Examiner*—Charles T. Jordan

[57] ABSTRACT

A shooters head immobilizing apparatus (10) for the cheekplate (104) of firearms (100); wherein, the apparatus (10) includes an anchor unit (11) attached to the forearm cheekplate (104) and a mouthpiece unit (12) including a mouthpiece base member (16) a generally flexible tether member (17) and a generally resilient tab member (18) wherein the anchor unit (11) and the mouthpiece base member (16) are provided with the cooperating portions (13') (13'') of a conventional hook and loop releasable fastening arrangement.

5 Claims, 1 Drawing Sheet

SHOOTERS HEAD IMMOBILIZING APPARATUS

TECHNICAL FIELD

The present invention relates generally to the field of head immobilizing devices for sports enthusiasts, and more particularly to a head immobilizing apparatus for shooters.

BACKGROUND OF THE INVENTION

One of the most persistent problems that plagues the majority of both shotgun and rifle shooters is the proper and consistent placement of the shooters face against the cheekplate of the firearm stock such that the shooters eye will be aligned with the firearm sights.

As can be seen by reference to the Shattuck device which was granted U.S. Pat. No. 803,791, the aforementioned problem and at least one patented solution were in existence as early as the beginning of this decade.

In light of the aforementioned situation there has existed a longstanding need among todays firearm enthusiasts for a modern day version of a sighting attachment for firearms that would follow the same basic principles of the Shattuck invention; but, which also would take into account certain parameters that were not present or even remotely contemplated at the turn of the century.

SUMMARY OF THE INVENTION

Briefly stated, the shooters head immobilizing apparatus that forms the basis of the present invention comprises a stock attached anchor unit releasably connected to a mouthpiece unit.

The stock attached anchor unit comprises an anchor member formed from one portion of a conventional hook and loop releasable fastening arrangement; wherein, the back of the anchor member is securely affixed at a selected location to the cheekplate of the stock of a firearm.

The mouthpiece unit comprises a mouthpiece member which includes the other portion of the conventional hook and loop releasable fastening arrangement which is operatively secured to a flexible tether member and a tab member that is connected to the free end of the flexible tether member.

In practice the user would mount the anchor unit on the stock of a firearm and then the user would preposition the mouthpiece unit relative to the anchor unit such that when the user grasped the button member in their mouth, the users cheek would be in firm contact with the firearm cheekplate and the users line of sight would be in proper alignment with the sights on a firearm.

In the preferred embodiment of this invention the tab member would be fabricated from a generally resilient material such as rubber, or the like, such that when the recoil from the firearm is transmitted to the shooter, the head immobilizing apparatus will not injure the users mouth and/or teeth due to the flexible and resilient nature of the mouthpiece unit coupled with the releasable cooperation between the mouthpiece unit and the anchor unit of this invention.

BRIEF DESCRIPTION OF THE DRAWINGS

These and other objects, advantages and novel features of the invention will become apparent from the detailed description of the best mode for carrying out the preferred embodiment of this invention which follows; particularly when considered in conjunction with the accompanying drawings, wherein.

p BEST MODE FOR CARRYING OUT THE INVENTION

Figure 1:
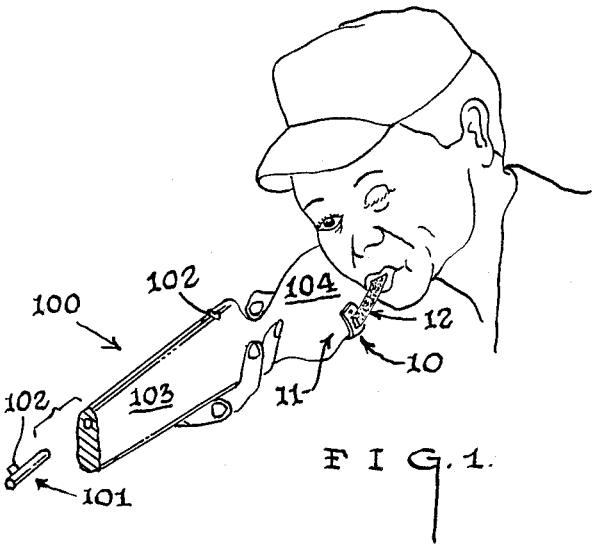
FIG. 1 is a perspective view of the apparatus mounted on a firearm.

As can be seen by reference to the drawings and in particular to FIG. 1, the shooters head immobilizing apparatus that forms the basis of the present invention is designated generally by the reference numeral (10) and is intended for use with a long bore firearm (100) having a barrel (101) equipped with sights (102) and a stock (103) having a cheekplate surface (104). The head immobilizing apparatus (10) comprises in general: an anchor unit (11) and a mouthpiece unit (12).

Figure 2:
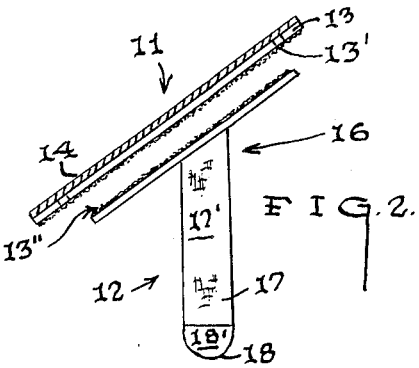
FIG. 2 is an exploded top plan view of one version of the preferred embodiment of the invention.
Figure 3:
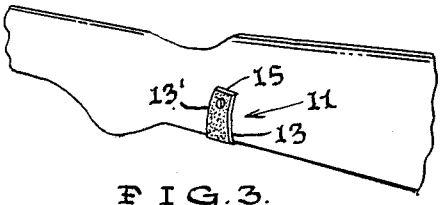
FIG. 3 is an isolated view of the anchor unit.
Figure 6:
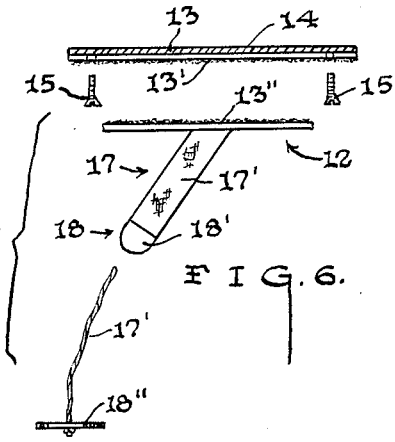
FIG. 6 is an exploded top plan view of the apparatus showing both versions of the tether and tab members.

As can be seen by reference to FIGS. 2, 3, and 6 the anchor unit (11) comprises an anchor member (13) formed from one portion (13') of a conventional hook and loop releasable fastening arrangement; wherein the anchor member (13) is further provided with suitable securing means such as adhesives (14) or threaded screws (15) for mounting the anchor member (13) at a selected location on the cheeckplate (104) of a firearm (100).

Figure 5:
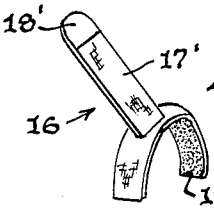
FIG. 5 is an isolated view of one version of the mouthpiece unit.

In the first version of the preferred embodiment depicted in FIGS. 2 and 5, the mouthpiece unit (12) comprises a mouthpiece base member (16) which includes: the other portion (13") of the conventional hook and loop releasable fastening arrangement; a generally flexible tether member (17) attached on one end to the mouthpiece member (16) and provided on its free end with a generally resilient tab member (18).

In the first version of the preferred embodiment the tether member (17) comprises a generally elongated thin flat strap element (17'); and, the resilient tab member (18) comprises a generally thin flat tab element (18') fabricated from generally flexible pliant material such as rubber, leather, plastic or the like.

Figure 4:
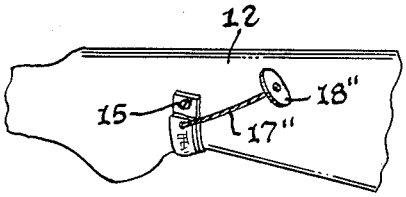
FIG. 4 is a perspective view of another version of the preferred embodiment mounted on a firearm.

In the second version of the preferred embodiment depicted in FIGS. 4 and 6, the tether member (17) comprises a generally thin strand element (17") of generally flexible material; and, the tab member (18) comprises a resilient button element (18").

It should also be noted at this juncture that in both the first and second versions of the preferred embodiment depicted in the drawings, the tether member (17) and the tab member (18) cooperate in exactly the same manner with the mouthpiece base member (16) to provide a head immobilizing apparatus (10) for firearm enthusiasts.

Having thereby described the subject matter of this invention it should be apparent that many substitutions, modifications, and variations of the apparatus (10) are possible in light of the above teachings. It is therefore to be understood that the invention as taught and described herein is only to be limited to the extent of the breadth and scope of the appended claims.

I claim:

1. A shooters head immobilizing apparatus for use on a firearm having a cheekplate wherein the apparatus comprises:

an anchor unit comprising an anchor member formed from one portion of a conventional hook and loop releasable fastening arrangement; wherein, the anchor member is further provided with securing means for fastening the anchor member to the cheekplate of a firearm; and, a mouthpiece unit comprising: a mouthpiece base member including the other portion of the conventional hook and loop releasable fastening arrangement; a generally flexible tether member having one end attached to the mouthpiece base member; and, a resilient tab member attached to the other end of said tether member.

2. The apparatus as in claim 1 wherein the tether member comprises:

a generally thin flat strap element.

3. The apparatus as in claim 2 wherein the tab member comprises:

a generally thin flat tab element.

4. The apparatus as in claim 1 wherein the tether member comprises:

a generally thin strand element.

5. The apparatus as in claim 4 wherein the tab member comprises:

a generally resilient button element.

* * * * *